United States Patent [19]

Sato

[11] 4,214,529

[45] Jul. 29, 1980

[54] CONSTANT PRESSURE PRINTING MECHANISM FOR HAND LABELER

[75] Inventor: Yo Sato, Tokyo, Japan

[73] Assignee: Kabushiki Kaisha Sato Kenkyusho, Tokyo, Japan

[21] Appl. No.: 921,247

[22] Filed: Jul. 3, 1978

[30] Foreign Application Priority Data

Jul. 15, 1977 [JP] Japan ..... 52-084203

[51] Int. Cl.[2] ..... B41J 5/00

[52] U.S. Cl. ..... 101/291

[58] Field of Search ..... 101/287-292; 156/384

[56] References Cited

U.S. PATENT DOCUMENTS

| | | | |
|---|---|---|---|
| 2,073,902 | 3/1937 | Olivetti | 400/452 |
| 3,911,817 | 10/1975 | Becker et al. | 101/288 |
| 4,072,105 | 2/1978 | Becker et al. | 101/288 |
| 4,149,462 | 4/1979 | Sato | 101/291 |

FOREIGN PATENT DOCUMENTS 53-7357 3/1978 Japan .

*Primary Examiner*—William Pieprz

*Attorney, Agent, or Firm*—Ostrolenk, Faber, Gerb & Soffen

[57] ABSTRACT

A constant pressure printing mechanism for use with a hand labeler: a printing platen is mounted on the frame of the hand labeler for pivotal movement toward and away from a position awaiting a coming printing head; the platen is biased apart from the printing head; constant pressure means, responsive to the operation of the hand lever, turn the printing platen toward the printing head to the awaiting position; the constant pressure means includes overridable means carried by either of the hand lever or the printing platen and overriding means carried by the other; when the hand lever is squeezed, the overriding means engages the overridable means thus shifting the platen to its awaiting position and further pressure is applied until the overriding means rides over the overridable means simultaneously as the printing head abuts against the printing platen at the awaiting position; the printing pressure to be applied to the label on the printing platen can be preset at a constant level by the force which is required for causing the ride-over operation.

15 Claims, 12 Drawing Figures

CONSTANT PRESSURE PRINTING MECHANISM FOR HAND LABELER

BACKGROUND OF THE INVENTION

1. Field of the Invention

The present invention relates to a label printing and applying machine of a portable type (which will hereafter be referred to as a "hand labeler"), and more particularly to a constant pressure printing mechanism for use with the hand labeler, by which the printing pressure is preset at a constant level within a narrow range.

2. Description of the Prior Art

In such a hand labeler, the printing head is carried by the hand operated lever, and that lever is pivotally connected to the body of the hand labeler. Through manual squeezing of the hand lever, the printing head is brought into abutment contact with the print surface of the platen, so that labels, or the like material to be printed, on the platen may be printed with desired indicia.

Since the platen of such a conventional hand labeler is fixed to the body of the hand labeler, the printing pressure of the printing head is directly dependent upon the squeezing force that is applied to the hand lever. If the hand lever is gripped with excessive squeezing force, the resultant excessive printing force cannot be damped by the platen, so that the printing head generates slight vibrations in the directions to and from the platen resulting in double printing of the labels, especially when the type surface of the printing head is made of metal. If the type surface of the printing head is made of an elastic material, on the other hand, it is crushed into abutment contact with the labels so that the ink oozes from the type surfaces onto the labels, making the resultant imprints unclear.

Since, moreover, the type of surface of the printing head is held in contact with the platen even after the printing operation until the hand lever is finally released from its squeezed condition, excessive ink will ooze out of the type surface of the printing head, if the ink is sufficiently fluid. Then, the resultant imprint is often unclear.

SUMMARY OF THE INVENTION

It is, therefore, an object of the present invention to provide a constant pressure printing mechanism for use with a hand labeler, or the like, which is free from the drawbacks of conventional label printing and applying devices.

It is another object of the present invention to provide a constant pressure printing mechanism of the above type, in which the time interval for the abutment contact between the printing head and the platen can be preset at a constant level and in which the printing pressure of the printing head can be maintained at a constant level within a preset short range.

It is a further object of the invention to make it possible to ensure clear imprints on the labels without any shading and to prevent double printing while reducing the impact and reaction.

The present invention concerns a constant pressure printing mechanism for use with a hand labeler that prints a label and may then apply the printed label to a commodity. The constant pressure printing mechanism comprises the following features. There is a hand lever that is mounted on the frame of the hand labeler for pivotal movement between a released position and a squeezed position. A return spring biases the hand lever toward its released position.

A printing platen is mounted on the frame of the hand labeler for pivotal movement. The platen has a biased position which is away from a position at which a label thereon may be printed. The biased position occurs when the hand lever is at the released position. The platen has an awaiting position, at which a label on the platen may be printed, where the platen is awaiting the printing operation which occurs when the hand lever is in the vicinity of its squeezed position and the printing head contacts the platen.Platen biasing means bias the printing platen away from the printing head to the biased position.

A printing head is carried by the hand lever and is movable between an inoperative position, at which it is apart from the printing platen when the platen is at the biased position and the hand lever is at the released position, and a printing position at which the printing head is in abutment contact with the printing platen which is then at the awaiting position while the hand lever is in the vicinity of the squeezed position. Stopper means are mounted on the frame of the hand labeler and are positioned to stop the printing platen at the awaiting position.

Constant pressure means responsive to the operation of the hand lever turn the printing platen toward the printing head against the biasing action of the platen biasing means as the hand lever approaches the squeezed position. The constant pressure means include overridable means carried by one of the hand lever and the printing platen and overriding means carried by the other of the hand lever and made engageable with the overridable means. When the hand lever is squeezed, the overriding and overridable means abut and the platen is moved to the awaiting position. Continued squeezing of the hand lever increases the printing force applied by the printing head until the overriding means finally rides over the overridable means, simultaneously as the printing head comes into abutment contact with the printing platen under a predetermined pressure at the awaiting position. As a result, the printing pressure that is to be applied by the printing head to the printing platen is determined at a constant level in terms of the force which is required for the ride-over operation and this force is independent of the intensity of the total squeezing force applied to the hand lever by any particular operator.

BRIEF DESCRIPTION OF THE DRAWINGS

Other objects and features of the present invention will become apparent from the following description taken in conjunction with the accompanying drawings, in which:

FIG. 8(*b*) is a view similar to FIG. 7(*b*) showing the condition of FIG. 8(*a*);

FIG. 9(*b*) is a view similar to FIGS. 7(*b*) and 8(*b*) showing the condition of FIG. 9(*a*).

DESCRIPTION OF THE PREFERRED EBODIMENTS

Figure 1:
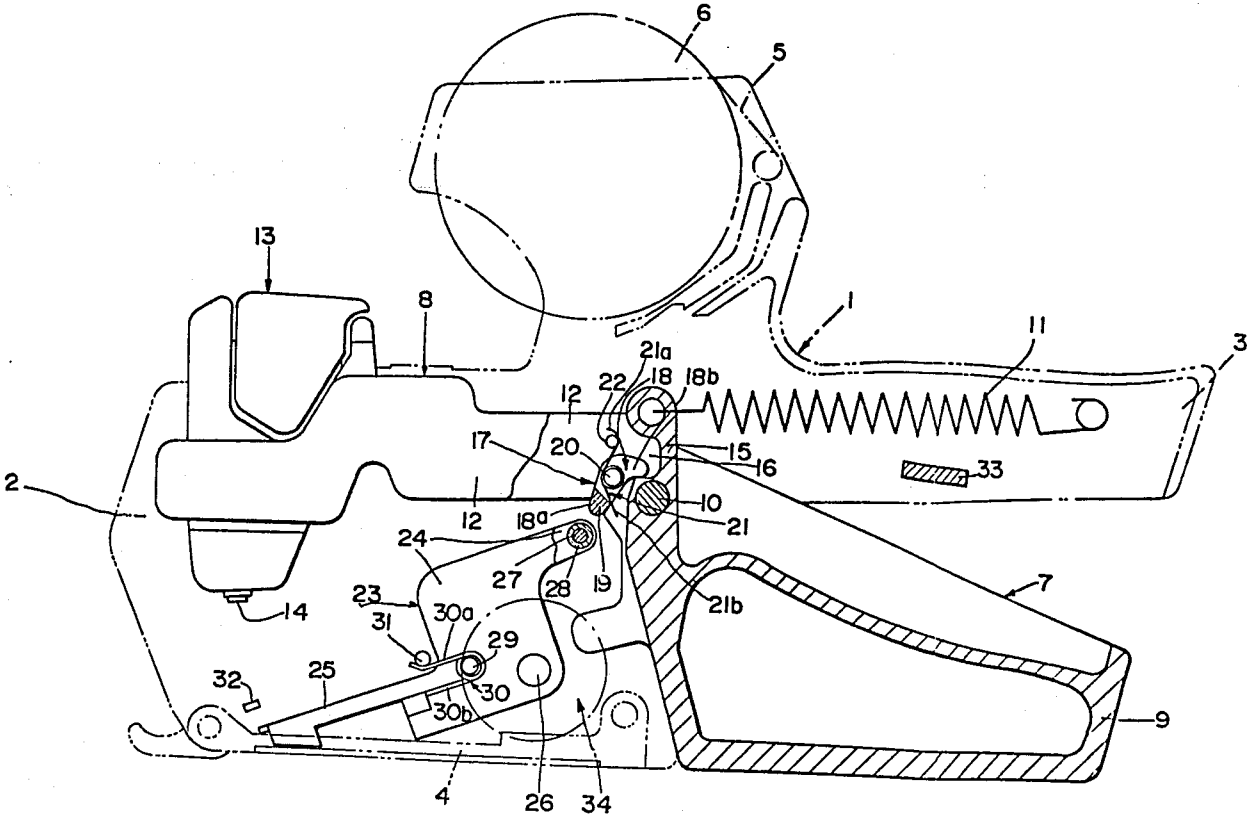
FIG. 1 is a partially cross-sectional, side elevational view showing a hand labeler, which is equipped with a constant pressure printing mechanism according to the present invention with its hand lever released and with the side plate of the labeler on the viewing side being removed.

A first embodiment of the present invention is now described with reference to FIGS. 1 to 3. The hand labeler has a body 1, which includes a pair of side plates 2 juxtaposed to and spaced apart from each other. A grip 3 is formed integrally with to protrude backwardly from the side plates 2 (i.e. to the right in FIG. 1). A bottom closure 4 is removably attached to the lower end portions of the side plates 2. A label holder 5 is provided at the upper rear end portion of the side plates 2. A roll of material to be printed, such as a continuous label strip 6, is wound on the label holder. The label strip 6 is comprised of a strip of backing paper and a number of labels that are removably adhered in series to the backing paper.

A hand lever 7 is interposed between and is pivotally supported on the side plates 2 of the body 1. The hand lever 7 has a front half which is formed into a yoke 8 (as seen at the left in FIG. 1) and has a rear half that is formed into a hand grippable portion 9. The hand lever 7 is pivotally mounted between the side plates 2 by means of its center pivot pin 10. A return coil spring 11 is interposed under tension between an upper center portion of the hand lever 7 and a rear end portion of the grip 3. This biases the hand lever 7 clockwise about the pivot pin 10.

The yoke 8 has a pair of side walls 12 which are juxtaposed to and spaced apart from each other. A printing head 13 is mounted between the side walls 12 and is formed at its lower end with a type surface 14. Desired types can be selectively arranged on the type surface 14 by known means, not shown.

Between the rear end portions of the side walls 12 of the yoke 8, there is an upwardly projecting, integral connecting portion 15, which has a control recess 16 with a substantially C-shaped cross-section that opens forward, toward the printing head 13.

An overriding means or operating assembly 17, which is spaced from the control recess 16, is mounted to the rear end portions of the side walls 12 of the yoke 8. The operating assembly 17 includes a pair of opposed, parallel, spaced apart, retaining side plates 18, each of which is formed into an L-shape, and further includes a connecting pin 19 which extends between and has its ends connected to the lower end portions 18*a* of the side plates 18. The side plates 18 of the operating assembly 17 are positioned along the inner sides of the side walls 12 of the yoke 8 while the connecting pin 19 is positioned in the vicinity of the lower edges of the side walls 12. The side plates 18 are pivotable about a center pivot pin 20 which is mounted between the side walls 12 of the yoke. A torsion spring 21 is wound on the center portion of the pivot pin 20. One end portion 21*a* of the spring 21 is mounted on a pin 22 that is fixed to the inner sides of the yoke side walls 12 and the other end portion 21*b* of the spring 21 is retained on the connecting pin 19 of the operating assembly 17. As a result, the operating assembly 17 is biased clockwise in FIG. 1 about the pivot pin 20, by the torsion spring 21 so that the other end portions 18*b* of the side plates 18 are retained on the bottom edge of the control recess 16 of the connecting portion 15.

A printing platen 23 is arranged near and above the lower end portions of the side plates 2 of the hand labeler body 1. The platen 23 has a pair of side plates 24, which are spaced from each other, and has a printing surface 25 which extends between the forward end portions of the side plates 24 and against which the type surface 14 of the printing head 13 is moved into abutment contact. Rotatably mounted between the lower center portions of the side plates 24 is a pivot pin 26 both ends of which are attached to both side plates 2 of the hand labeler body 1, whereby the platen pivots about the pin 26.

A pivot pin 27 is mounted between the upper rear ends of the platen side plates 24. Upon the pin 27 is mounted a cylindrical roller 28 which is made of an elastic material, such as rubber. The pin 27 and roller 28 combination together comprise the overridable means. The roller 28 is arranged so that it can be brought to and from the connecting pin 19 of the overriding means or operating assembly 17.

In front of the pivot pin 26, there are a pair of pins 29 which project from the outer sides of the platen side plates 24. A torsion spring 30 is wound at its center portion upon each of the pins 29. The torsion spring 30 has one end portion 30*a* mounted to each of pins 31, which project inwardly from the inner sides of the side plates 2, and has its other end portion 30*b* mounted to the outer sides of the platen side plates 24. The printing platen 23 is biased counterclockwise in FIG. 1 about the pivot pin 26 by the torsion spring 30 so that the leading lower side of the printing surface 25 is brought into engagement with the bottom 4 of the body 1 while retaining the same in position.

A pair of stoppers 32 are mounted on the forward lower portions of both side plates 2 of the body 1 so that rotation of the printing platen 23 toward the printing head 13 will be stopped at a preset awaiting position of the platen. Another stopper 33 is mounted on the lower center end portion of the inner side of the grip 3 so that counterclockwise rotation of the hand lever 7 will also be stopped at a preset position beyond its squeezed position and therefore beyond the position at which the printing head imprints a label then on the platen.

There is a feed roller 34, which is rotatably mounted on the pivot pin 26. By means not shown in this embodiment (but see FIG. 4), the feed roller 34 is turned a preset distance by each squeezing and releasing of the grip portion 9 toward and apart from the grip 3. This unrolls the leading end portion of the continuous label strip 6 from the label holder 5 and feeds it onto the printing surface 25 of the printing platen 23.

The operation of the first embodiment of the constant pressure printing mechanism of the hand labeler according to the present invention is now described.

FIG. 1 shows the released, inoperative condition of the hand labeler, under which the hand lever 7 is held in the released position by the biasing force of the return coil spring 11. In this condition, the operating assembly 17 is biased counterclockwise about the pivot pin 20 by the torsion spring 21 so that its retaining side plates 18 are retained at their other end portions in the control recess 16. The printing platen 23 is also biased counterclockwise, about the pivot pin 26 by the torsion spring 30 so that its printing surface 25 is retained at its lower end upon the bottom 4 of the body 1.

Figure 2:
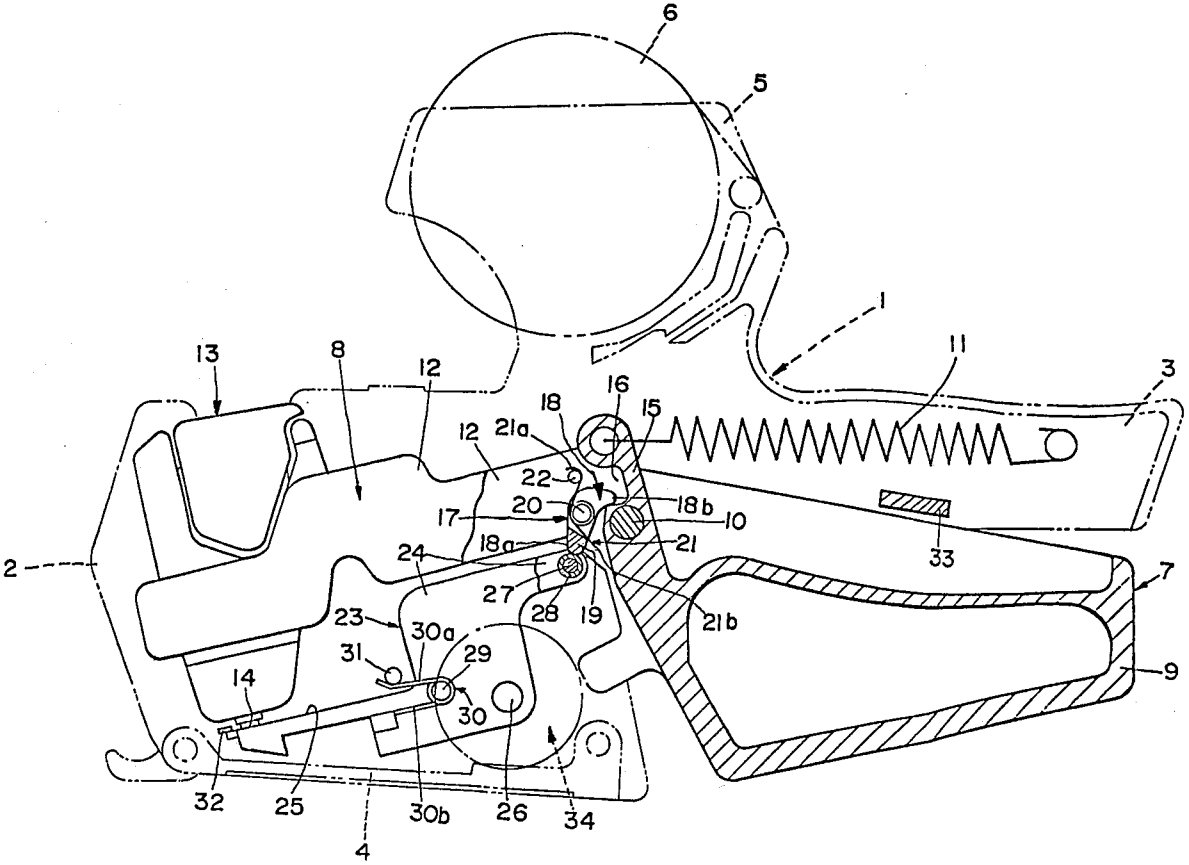
FIG. 2 is a view similar to FIG. 1 showing the condition under which the overriding means or operating assembly is brought into abutment engagement with the overridable means or roller by squeezing the hand lever through a preset angle midway of its squeezing stroke.
Figure 3:
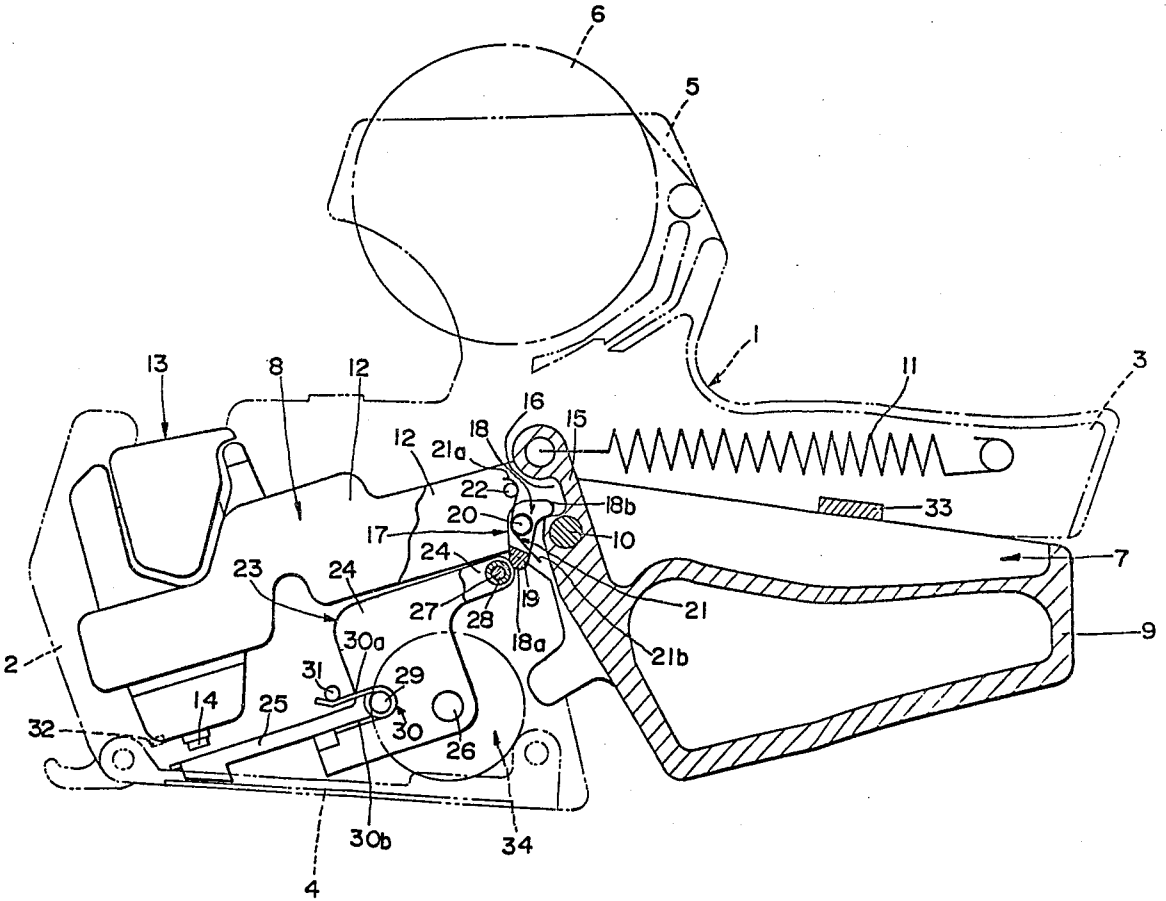
FIG. 3 is a view that is similar to FIGS. 1 and 2 showing the condition, under which the printing operation is finished by further squeezing of the hand lever over a preset angle through its full stroke.

As shown in FIG. 2, when the grip 3 and the grip portion 9 are now squeezed toward each other, the hand lever 7 is turned counterclockwise about the pivot pin 10 against the biasing force of the return coil spring 11. The printing head 13 and the operating assembly 17 are turned in the same direction about the pivot pin 10. When the hand lever 7 has been rotated through a present angle, the connecting pin 19 of the overriding means of operating assembly 17 comes into abutment engagement with the outer circumference of the roller 28 of the overridable means. Such contact forces the printing platen platen 23 to rotate clockwise against the biasing force of the torsion spring 30 until the upper printing suface 25 abuts the stoppers 32 of the side plates 2. At this intermediate awaiting position, there is a preset clearance between the upper surface of the continuous label strip 6 that is fed upon the printing surface 25 of the platen 23 and the type surface 14 on the underside of the printing head 13.

When the grip portion 9 is further squeezed counterclockwise from its intermediate position of FIG. 2, the printing head 13 and the operating assembly 17 are turned counterclockwise, until the type surface 14 comes into abutment contact with the continuous label strip 6 placed upon the printing surface 25 of the platen 23, and this imprints the label strip 6 with the desired indicia on the type surface.

Under this printing condition, when the printing pressure to be applied to the printing surface of the platen 23 reaches a preset level, the platen 23 is thereby turned counterclockwise about the pivot pin 26, whereupon the operating assembly 17 is allowed to ride rearwardly over the roller 28 against the biasing force of the torsion spring 21. The printing pressure upon the platen is set at a constant level that is determined by the force which is required for the rideover. Engagement between the platen 23 and the operating assembly 17 is released so that the platen 23 is freed to return counterclockwise under the biasing force of the torsion spring 30 until the platen is restored to its original position, as see in FIG. 3.

Even if the grip portion 9 of the hand lever 7 is squeezed still further counterclockwise, its upper side comes into contact with the stopper 33 so that the hand lever 7 is blocked from further rotation. In FIG. 3, the type surface 14 of the printing head 13 is positioned at a preset spacing from the printing surface 25 of the platen 23, and the roller 28 is also spaced from the operating assembly 17.

When the grip portion 9 of the hand lever 7 is released from its squeezed condition, the hand lever 7 is returned counterclockwise by the biasing force of the return coil spring 11. As a result, the printing head 13 and the operating assembly 17 are also returned counterclockwise.

When the operating assembly 17 is returned through a preset angle, the outer periphery of the connecting pin 19 abuts the rear side of the periphery of the roller 28. As a result, the operating assembly 17 is slightly turned counterclockwise about the pivot pin 20 by the roller 28 and against the biasing force of the torsion spring 21. That slight turn causes the torsion spring 21 to exert a biasing force that urges the operating assembly 17 clockwise about the pivot pin 20 for subsequent operation. Meanwhile, the operating assembly 17 is further turned clockwise about the pivot pin 10 as the hand lever 7 is further rotated until the lower end of the outer periphery of the connecting pin 19 abuttingly contacts the upper end of the outer circumference of the roller 28. Then the operating assembly 17 is turned clockwise about the pivot pin 20 by the biasing force which has been stored in the torsion spring 21. Eventually, the connecting pin 19 rides over the roller 28 in the opposite direction and separates therefrom.

Following this, the hand lever 7 is permitted to turn clockwise about the pivot pin 10 until it returns to the released, inoperative position shown in FIG. 1.

Figure 4:
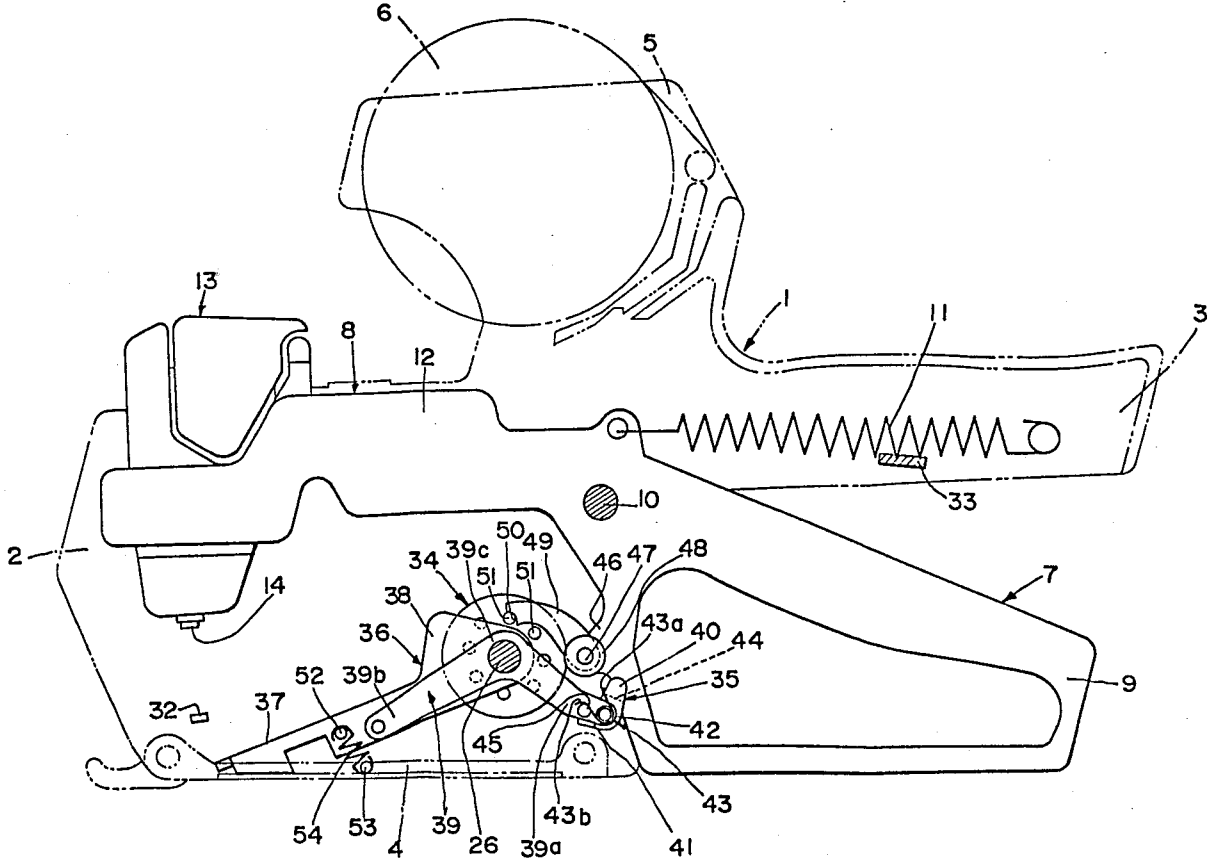
FIG. 4 is a partially cross-sectional, side elevational view showing a hand labeler, which is equipped with a constant pressure printing mechanism according to a second embodiment of the present invention with the hand lever released and with the side plate of the frame on the viewing side being removed.
Figure 5:
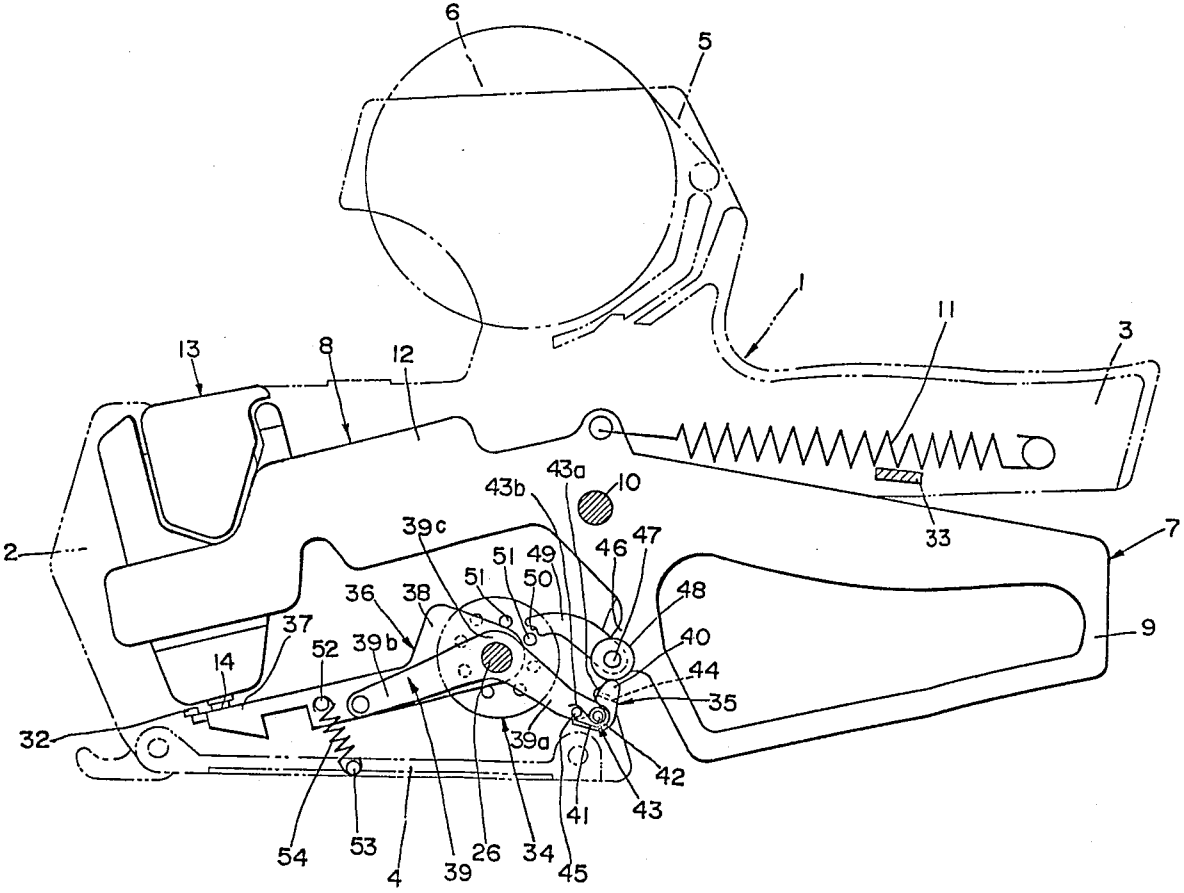
FIG. 5 is a view similar to FIG. 4 showing the condition under which the overriding means or operating assembly is brought into abutment engagement with the overridable means roller by squeezing of the hand lever through a preset angle midway of its squeezing stroke.

The second embodiment of the present invention is now described with reference to FIGS. 4 to 6. Corresponding elements to those of the first embodiment have similar reference numbers and they are not explained again. Ther major difference between the second embodiment and the first one resides in the construction and attachment of the overriding means or operating assembly 35 and the overridable means 47, 48 in FIG. 4.

The printing platen ahs a printing surface 37 at its forward end and includes a pair of side plates 38 mounted to both sides of the printing surface 37. A slightly bent, V-shaped arm member 39 is attached at its bend **39*c* and at its forward end portion 39*b* to the outer side of both side plates 38 and the rear end portions 39*a* of the arm members 39 protrude slightly downwardly from the rear end portion of each of the platen side plates 38**.

The overriding means or operating assembly 35 is pivotally mounted to the rearward end portion **39*a* of each of the arm members 39 and is thereby attached to the platen. Ther operating assembly 35 includes an operating portion 40, which is formed into a triangular shape and has a retaining step portion 44 at one side, and has a stopper portion 41 which is formed at one edge of the operating portion 40. The operating portion 40** is pivotally mounted at its center portion to the rearward end portion 39*a* of the arm member 39 through a pivot pin 42 while the stopper portion 41 is removably mounted to one side edge of the arm member 39.

A torsion spring 43 is mounted at its center portion on the pivot pin 42. One end portion 43*a* of spring 43 is retained in the retaining step portion 44 of the operating portion 40 and the other end portion 43*b* of spring 43 is retained on a retaining pin 45 which projects outwardly from the rearward end portion 39*a* of each of the arm members 39. The operating assembly 35 is biased clockwise, as viewed in FIG. 4, about the pivot pin 42 by the biasing force of the torsion spring 43 so that its stopper portion 41 is retained against the one side edge of the arm member 39.

The grip portion 9 of the hand lever 7 includes a projection 46, which projects forwardly from a center front edge of the hand lever 7. A pair of shafts 47 are formed at both sides of the projection 46. Rollers 48 are mounted to shafts 47 such that the rollers can be brought into abutment engagement with the operating portions 40 of the operating assembly 35. The rollers 48 are made of either an elastic material such as rubber or a rigid material such as metal and they have a generally cylindrical shape. The shafts 47 and rollers 48 comprise the overridable means.

A label strip advancing pawl 49 is rotatably attached at its rear end portion to each of the shafts 47. The pawl is positioned between the inner end face of each of the rollers 48 and the outer side of the projection 46. The advancing pawl 49 is arcuately curved in shape and has an engagement step portion 50 at its leading or forward end.

The label strip feed roller 34 is rotatably mounted on the pivot pin 26 which is interposed between the platen side plates 38. A plurality of engagement pins 51 are arranged equidistantly circumferentially around each outer side of the feed roller 34. The then uppermost engagement pin 51 is separably engageable with the engagement step portion 50 of the advancing pawl 49.

A pair of coil springs 54 are mounted under tension between pins 52, which pins project from the forward end portions of the platen side plates 38, and pins 53, which pins project inwardly from the lower end portions of the side plates 2 of the body 1 of the hand labeler. The printing platen 36 is biased counterclockwise about the pivot pin 26 by the biasing forces of the coil springs 54 so that the forward end portion of the printing surface 37 of the platen abuts the upper surface of the bottom 4 of the labeler.

The operation of the constant pressure printing mechanism of the hand labeler according to the second embodiment of the invention is now described. Basically, the operation of the second embodiment is similar to that of the first embodiment. When the grip portion 9 of the hand lever 7 is squeezed from the released, inoperative position of FIG. 4, the rollers 48 are turned counterclockwise about the pivot pin 10, just as the printing head 13 is turned, until the rollers 48 are swept rearwardly into abutment contact with the operating portions 40 of the operating assembly 35. Further counterclockwise motion of the rollers 48 raises the printing platen 36 clockwise, as seen in FIG. 5, about the pivot pin 26 until the printing surface 37 of the platen abuts the stoppers 32 on the frame at the awaiting position of the platen.

As the grip portion 9 is further squeezed, the type surface 14 of the printing head 13 is moved into abutment contact with the continuous label strip 6, which has been fed upon the printing surface 37 of the platen 36, so that the label strip 6 may be printed. Simultaneously with the printing, as seen in FIG. 6, the squeezing pressure is sufficient to cause rollers 48 to ride over the operating portions 40 of the operating assembly 35. As a result, engagement between the platen 36 and the operating assembly 35 is released, freeing the platen 36 to be separated from the type surface 14 of the printing head 13 by the biasing force of the springs 54 and restoring the platen to its original position.

Figure 6:
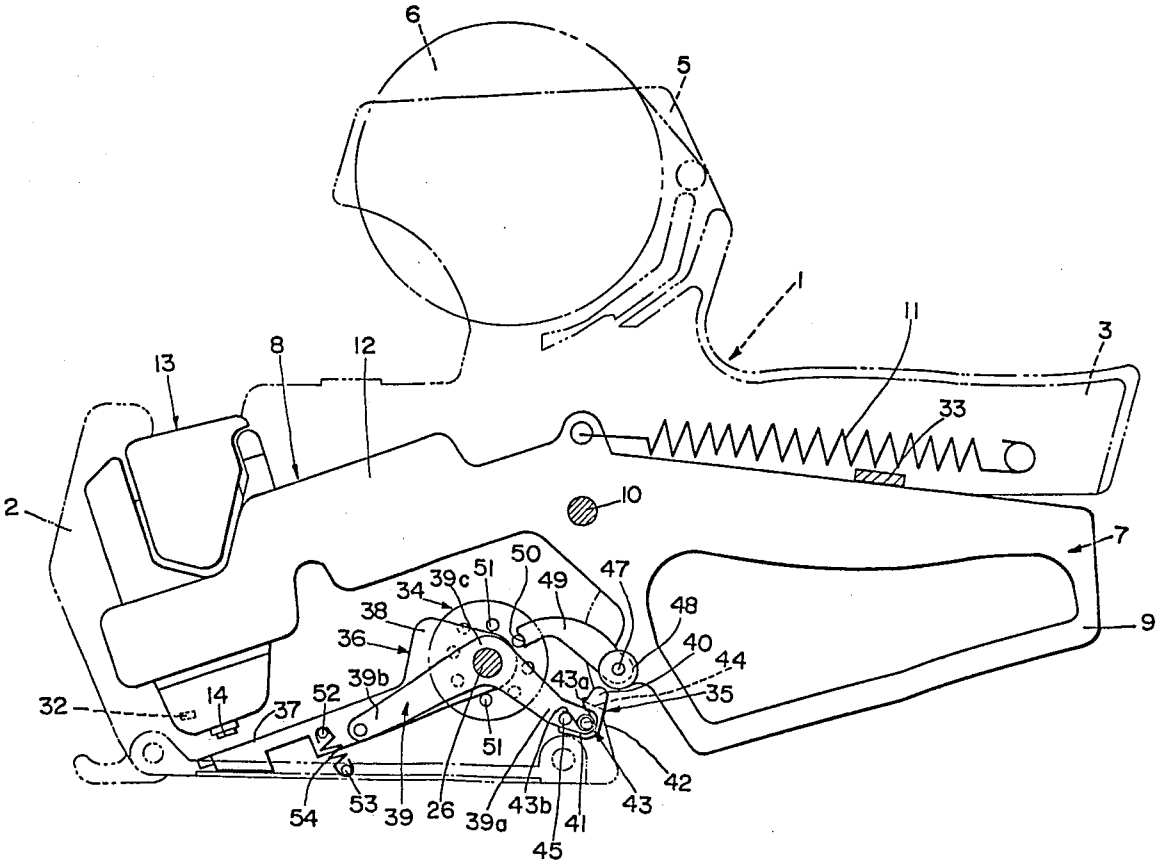
FIG. 6 is a view similar to FIGS. 4 and 5 showing the condition under which the printing operation is finished by further squeezing of the hand lever through a preset angle to its full stroke.

As seen in FIG. 6, further counterclockwise rotation of the hand lever 7 is blocked by the stopper 33 in the frame.

When the grip portion 9 of the hand lever 7 is released from its squeezed position of FiG. 6, the hand lever 7 is turned clockwise so that the rollers 48 are also turned clockwise about the pivot pin 10. Now, the rollers 48 sweep forwardly and abut the rear side of the operating portions 40 of the operating assembly 35 and then they leave the operating portions after the rollers turn the operating portions 40 counterclockwise about the pivot pin 42. Thus, the hand lever 7 is restored to its inoperative position of FiG. 4.

During the counterclockwise squeezing stroke of the hand lever 7, the engagement step portion 50 of the advancing pawl 49 is disengaged from the engagement pin 51, which is then at the uppermost position of each side of the feed roller 34, and the step portion is brought into engagement with the next engagement pin 51, which is just to the rear of the preceding pin 51. During release of the hand lever 7, on the other hand, the just engaged next engagement pin 51 is advanced to the uppermost position of the sides of the feed roller 34 by the movement of the engagement step portion 50 of the advancing pawl 49. This turns the feed roller 34 a preset distance counterclockwise, as viewed in Fig. 6, about the pivot pin 26 so that a preset length of the continuous label strip is fed onto the print surface 37 of the platen 36.

The second embodiment of the constant pressure printing mechanism is different from the first embodiment in the following specifics. No control recess 16 is needed in the yoke 8. The overriding means or operating assembly 35 is not attached to the side walls 12 of the yoke 8 but instead is attached to the rear end portions of each of the arm members 39, which are mounted to the platen side plates 36, whereby the operating assembly is effectively attached to the platen. In the first embodiment, the operating assembly is on the yoke while the rollers are on the platen. This relationship is reversed in the second embodiment. Production and assembly are simplified with the second embodiment, whereby the production cost can be reduced.

Although the rollers 48 and advancing pawls 49 are separate from each other in the second embodiment, the present invention is not limited to such a separate construction but it can instead be made wherein the rollers 48 are integral with the rear end portions of the advancing pawls 49. With this alternative, the number of required parts can be reduced, reducing the production cost and the printing of the continuous label strip 6 by the printing head 13 can be easily but reliably synchronized with the feeding of the label strip 6 by the feed roller 34.

As a further alternative, the platen side plates 38 can be made integral with the arm members 39.

The third embodiment of the present invention is now described with reference to FIGS. 7(*a*) to 9(*b*).

Corresponding parts have similar reference numbers to those of the first embodiment, and accordingly they are not explained again here.

The third embodiment differs from the first and second embodiments in both of the overriding means or operating assembly 55 and the rear end portions of the platen side plates 56 which serve as the overridable means. As shown in FIG. 7(*b*), the yoke 8 includes a connecting portion 57 that is formed with an extending circular bore 58. Both ends of the bore 58 are exposed to the outside through the respective small holes 59 which are formed in the side walls 12. The holes 59 are smaller in diameter than the bore 58.

The operating assembly 55 is mounted in the bore 58. The assembly comprises a pair of spaced apart operating members 60 and a compression coil spring 61 between them. Each of the operating members 60 includes a cylindrical body 62 and a retaining projection 63 that projects from the outside of the respective end of the cylindrical body 62. The outside ends of the retaining projections 63 are generally hemispherically shaped. Each operating member 60 is fitted in the bore 58 such that its cylindrical body 62 is axially slidable in the bore 58 and so that its retaining projection 63 is made movable both to the outside of and back into the bore 58 through the hole 59. The compressed coil spring 61 between the inner ends of the cylindrical bodies 62 biases the operating members 60 apart so that the retaining projections 63 are forced outwardly through the holes 59.

Figure 7A:
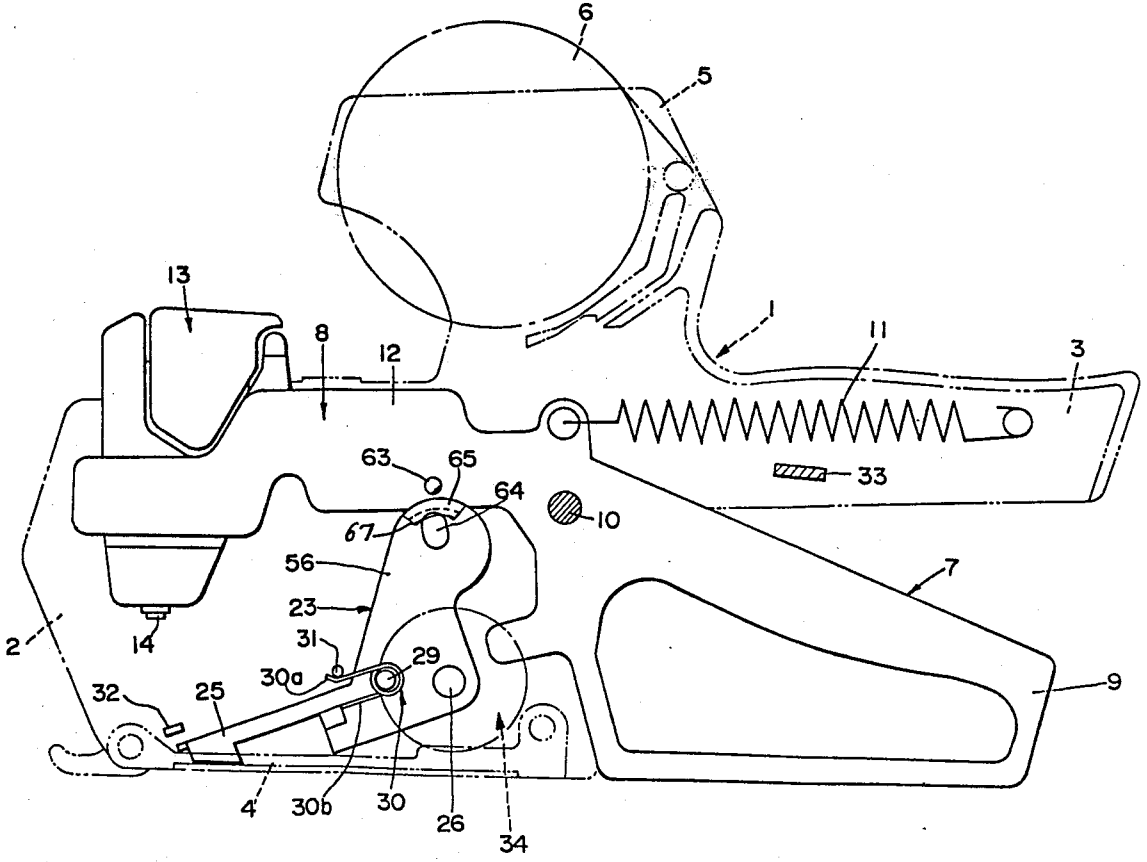
FIG. 7(*a*) is a partially cross-sectional, side elevational view showing a hand labeler, which is equipped with a constant pressure printing mechanism according to a third embodiment of the present invention with the hand lever released and with the side plate of the frame on the viewing side being removed.
FIG. 7(b) is a longitudinal cross-sectional view taken across the labeler and showing the operating assembly.
Figure 7B:
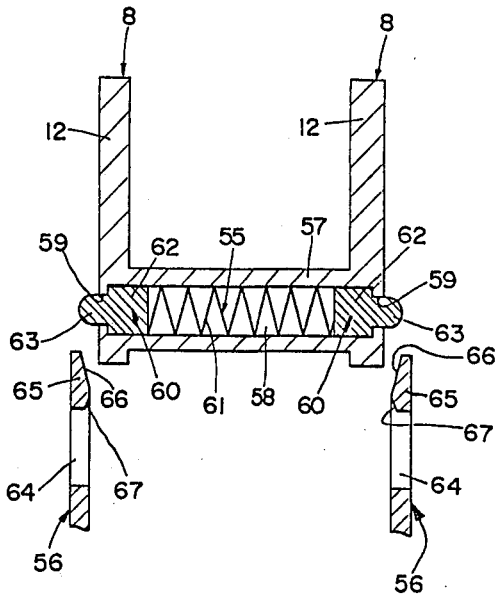

As seen in FIG. 7 (*a*), the upper rear end portions of the platen side plates 56 are generally circular in shape. A pair of elliptically shaped holes 64 are formed in the platen side plates 56 at a spacing from the circular upper end portions of the plates. In FIG. 7(*b*), each of the platen side plates 56 has an upper rear end portion 65 that is formed on its inner side with both a first taper surface 66, which progressively thickens downwardly from the upper edge of the side plate, and a second taper surface 67 which progressively thins downwardly from the lower end of the first taper surface 66 to the upper edge of the elliptical hole 64. These tapered surfaces cooperate with the rounded heads of the projections 63, as described below.

The operation of the constant pressure printing mechanism of the third embodiment is now described. The operation of the third embodiment is basically similar to those of the first and second embodiments, except for the manner in which the operating assembly 55 elastically coacts with the platen side plates 56.

More specifically, when the hand lever 7 is in the released, inoperative condition shown in FIG. 7(*a*) the operating members 60 of the operating assembly 55 are biased to their respective ends of the bore 58 by the coil spring 61 so that their respective retaining projections 63 protrude outside the holes 59 of the yoke 8.

Figure 8A:
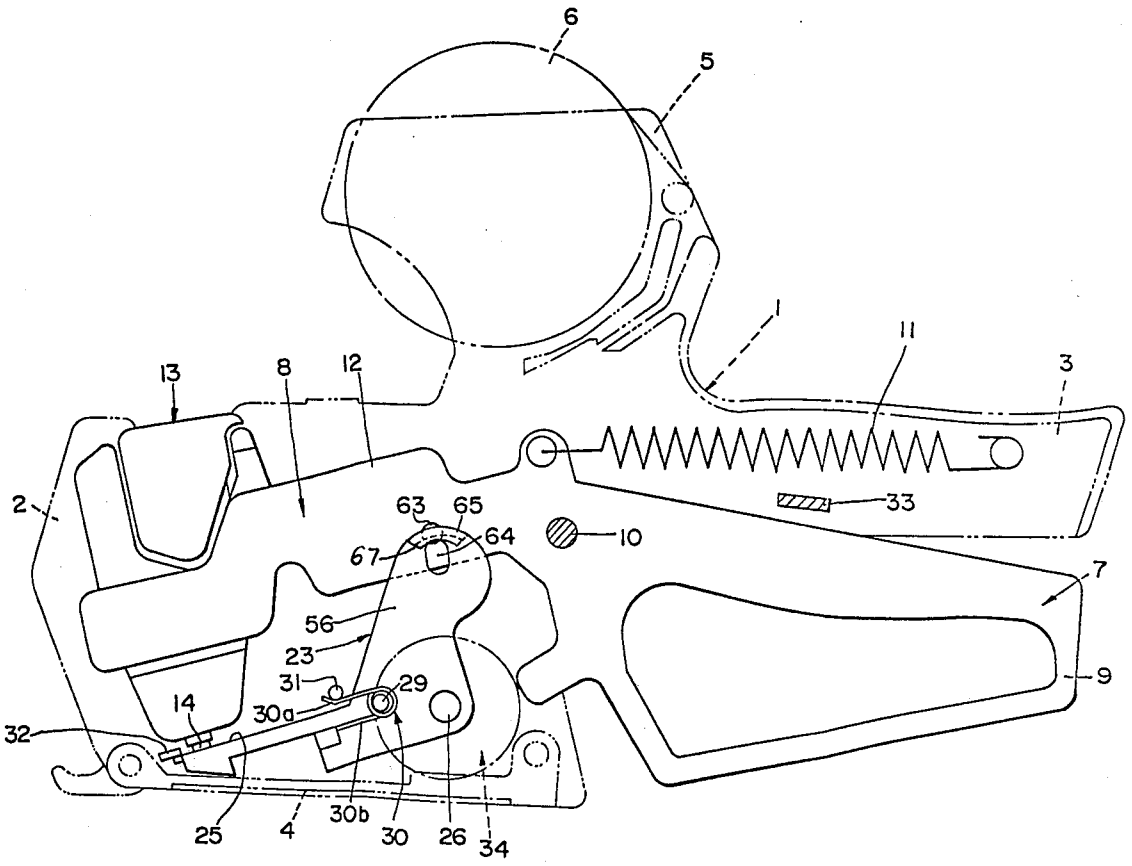
FIG. 8(*a*) is a view similar to FIG. 7(*a*) showing the condition under which the operating assembly is brought into abutment engagement with the platen side plates by squeezing of the hand lever through a preset angle midway of its squeezing stroke.
Figure 8B:
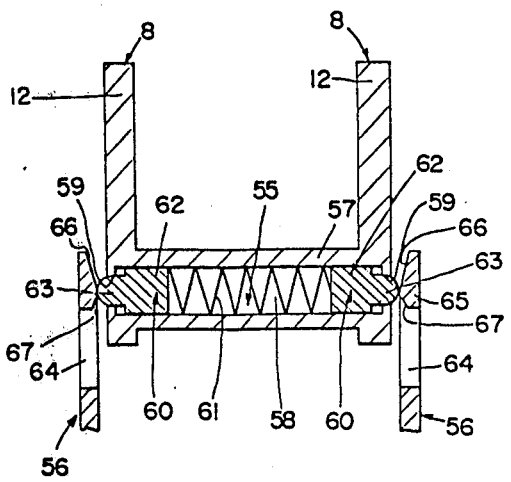

When the grip portion 9 of the hand lever 7 is squeezed from the inoperative position, turning the hand lever 7 counterclockwise, then the retaining projections 63 of the operating assembly 55 abut the first taper surfaces 66 of the respective platen side plates 56, as shown in FIG. 8(*a*). The spring 61 is strong enough so that the operating members are not forced back into the bore 58. Instead, further rotation of lever 7 turns the platen 23 clockwise about the pivot pin 26 until its print surface 25 is lifted to abut the stoppers 32 on the frames stopping further motion of the platen. As squeezing of the hand lever now continues, each of the retaining projections 63 of the operating assembly 55 is moved downwardly from the thinner upper edge of the first taper surface 66 to the thicker upper edge of the second taper surface 67, as seen in FIGS. 7(*b*) and 8(*b*), and the projections are at the same time forced slightly into the bore 58 against the bias of the coil spring 61. At the time corresponding to the condition shown in FIG. 8(*b*), the printing platen 23 is elastically supported at the inner sides of its side plates 56 by the outwardly biased operating members 60.

Figure 9B:
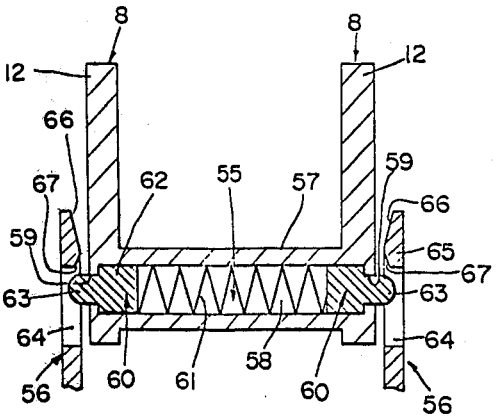
FIG. 9(*a*) is a view similar to FIGS. 7(*a*) and 7(*b*) showing the condition under which the printing operation has been finished by further squeezing of the hand lever through its full stroke.
Figure 9A:
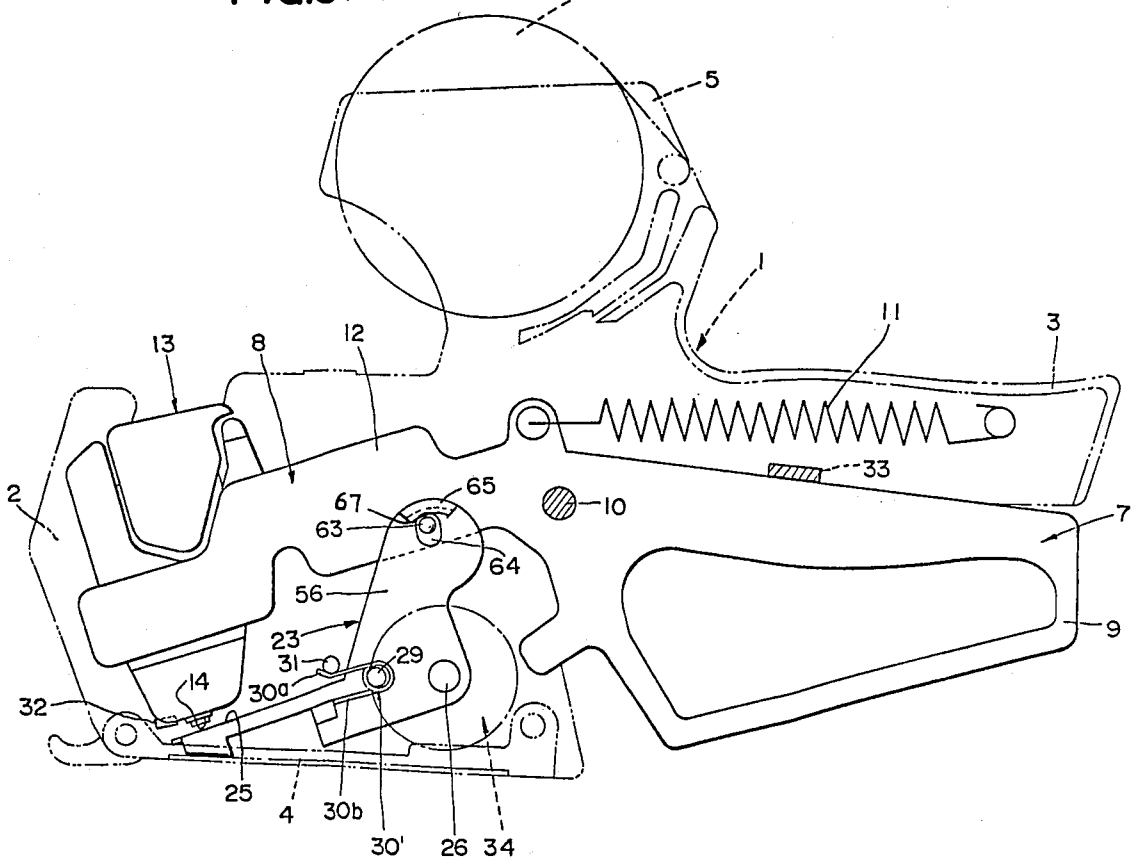

When the grip portion 9 of the hand lever 7 is further squeezed counterclockwise from the condition shown in FIG. 8(*a*), the type surface 14 of the printing head 13 is brought into abutment contact with the continuous label strip 6, which has been fed onto the print surface 25, and the label strip 6 is thereby printed. Simultaneously with the printing operation, as seen in FIGS. 9(*a*) and 9(*b*), the retaining projections 63 of the operating members 60 are moved downwardly over the thinning second taper surfaces 67 of the platen side plates 56 until they snap into the elliptical holes 64 in the platen side plates 56. This disengages the platen 23 and the operating assembly so that the platen 23 is freed to return counterclockwise under the bias of the torsion springs 30, thereby restoring the platen to its original position. All of this is shown in FIG. 9(*a*). The elliptically shaped, elongated holes 64 provide clearance for this return motion of the platen with respect to the then relatively slower moving yoke 8 and projections 63.

As seen from FIG. 9(*a*), further counterclockwise rotation of the hand lever 7 is blocked by the abutment of the grip portion 9 against the stopper 33. As a result, the type surface 14 of the printing head 13 is maintained separated from the print surface 25 of the printing platen 23

When the grip portion 9 of the hand lever 7 is released from the squeezed position of FIG. 9(*a*), the hand lever 7 returns clockwise so that the retaining projections 63 of the operating assembly 55 leave the elliptical holes 64 and pass the second and then the first taper surfaces 67 and 66 of the platen side plates 56. Thus, the hand lever 7 is restored to its initial inoperative position of FIG. 7(*a*).

As can be understood from the foregoing description, the constant pressure printing mechanism according to the third embodiment is constructed so that the printing platen 23 can be elastically supported in the printing position by the action of the operating members 60 which are biased by the coil spring 61. Thus, excessive printing pressure, which might otherwise be established when the printing head 13 abuts the platen 23, can be elastically damped to a preset level by the action of the platen 23 while ensuring clear printing of the continuous label strip 6 in a simple but reliable manner.

Since, moreover, the platen side plates 56 are formed with the first and second taper surfaces 66 and 67, the retaining projections 63 of the operating members 60 can enter and leave the elliptical holes 64 of the side plates 56 smoothly. The operating efficiency of the hand lever 7 can thus be improved, and abutment contact between the printing head 13 and the printing platen 23 can be carried out within a short time, thus reliably preventing double printing.

The third embodiment of the constant pressure printing mechanism is constructed such that the operating members 60 move into and out of the bore 58 in an elastic fashion through the small holes 59 which are formed in the side walls 12 of the yoke 8. In one alternative, the retaining projections 63 are made of an elastic, compressible material and are integral with the side walls 12 of the yoke 8. This alternative has the advantage that the number of parts required can be reduced together, thereby lowering the production cost while simplifying the overall construction.

In all embodiments, because the printing platen is detached from the printing head virtually as soon as they abut, the printing pressure can be preset at a constant level within a short range so as to ensure clear printing upon the labels, while preventing double printing. This is quite different from conventional labelers, in which the printing head is kept in contact with the printing platen even after the printing operation, which applies excessive printing pressure to the labels or overinks them.

The approach and departure of the printing platen to and from the printing head can be accomplished smoothly and promptly because they are accomplished through the riding over of cooperating means on each of them.

Even if the squeezing force applied to the hand lever is so high that the printing head hits the printing platen with excessive printing pressure, engagement between the platen and the operating assembly can be instantaneously released so that the time period required for the printing operation can be at a preset value within a preset short range, thus ensuring clear printing without any diffusion of ink over the labels.

Finally, since the printing platen moves from the printing head once they have approached, the moving stroke of the platen can be so small as to simplify the overall construction of the constant pressure printing mechanism while reducing its size.

Although the present invention has been described in connection with a plurality of preferred embodiments thereof, many variations and modifications will now become apparent to those skilled in the art. It is preferred, therefore, that the present invention be limited not by the specific disclosure herein, but only by the appended claims.

What is claimed is:

1. A constant pressure printing mechanism for use with a hand labeler which is operative to print a label, comprising:

a frame;

a hand lever mounted on said frame for movement between a released position and a squeezed position;

a printing platen having a printing surface; said platen being mounted to said frame for movement between a normal biased position, which occurs when said hand lever is at said released position and is moving toward said squeezed position thereof, and an awaiting position at which said platen is moved such that its said printing surface is awaiting the printing operation, which occurs when said hand lever is moved into the vicinity of said squeezed position thereof; platen biasing means for biasing said platen to said biased position thereof;

a printing head connected to said hand lever and movable thereby between an inoperative position, which is apart from said platen when said platen is at said biased position and when said hand lever is at said released position, and a printing position, at which said printing head is abutting said platen when said platen is at said awaiting position and when said hand lever is in the vicinity of said squeezed position;

constant pressure means responsive to the operation of said hand lever for moving said platen toward said printing head against the bias of said platen biasing means as said hand lever approaches said squeezed position; said constant pressure means including overridable means carried by said platen and further including overriding means carried by said hand lever and being engageable with said overridable means when said hand lever is moving toward said squeezed position thereof; said overriding means comprising an element which is normally spring biased to a side of said hand lever with respect to the path of motion of said hand lever between said squeezed and said released positions thereof; as said hand lever is being moved toward said squeezed position thereof, said overriding means element abutting said overridable means; said element being biased to a position at which said element prevents bypassage of said overridable means; said overridable means including a first taper surface formed on said platen which tapers in a direction such that as said hand lever moves toward said squeezed position thereof, said first taper surface urges said element to move in a direction which increases the spring bias thereupon;

spring biasing means for biasing said overriding means element to its said position at which it prevents bypassage of said overridable means; said pring biasing means being adapted to exert sufficient spring biasing force for causing said platen to be moved to said awaiting position thereof as said hand lever is moved toward said squeezed position after said overriding means has engaged said overridable means, instead of said spring biasing means permitting said element to simply move past said first taper surface; said overridable means being shaped and positioned to move said overriding means out of said position for blocking their bypassage, such that further such motion of said hand lever toward said squeezed position moves said overriding means to apply pressure to said overridable means until the applied pressure is sufficient to cause said overridable means to shift said platen to said awaiting position against the bias of said platen biasing means, and continued such motion of said hand lever to said squeezed position moving said overriding means to ride over said overridble means; said overriding means and said overridable means being respectively so shaped and positioned that said ride over occurs simultaneously as said printing head comes into abutment contact with said platen at said platen awaiting position, whereby the printing pressure to be applied by said printing head to said platen is determined at a constant level in terms of the force which is required to be applied to said hand lever for said ride over.

2. The constant pressure printing mechanism of claim 1, wherein said printing head is carried by said hand lever for moving therewith.

3. The constant pressure printing mechanism of claim 1, further comprising a return spring for biasing said hand lever toward said released position.

4. The constant pressure printing mechanism of claim 1, wherein said hand lever is pivotally mounted on said frame for pivotal motion between its said

5. The constant pressure printing mechanism of claim 1, wherein said platen is pivotally attached to said frame at a platen pivot for pivoting between said platen positions.

6. The constant pressure printing mechanism of claim 5, wherein said hand lever is pivotally mounted on said frame for pivotal motion between its said positions.

7. The constant pressure printing mechanism of claim 5, wherein said printing head is carried by said hand lever for moving therewith.

8. The constant pressure printing mechanism of claim 7, wherein said hand lever is pivotally mounted on said frame for pivotal motion between its said positions.

9. The constant pressure printing mechanism of claim 8, further comprising a return spring biasing said hand lever toward said released position.

10. The constant pressure printing mechanism of claim 5, further comprising a return spring biasing said hand lever toward said released position.

11. The constant pressure printing mechanism of claim 5, wherein said platen printing surface is at one side of said platen pivot and the respective one of said overriding means and said overridable means on said platen is at the other side of said platen pivot.

12. The constant pressure printing mechanism of claim 1, wherein;

said overriding means includes an operating assembly which is mounted on said hand lever, said operating assembly including a generally L-shaped retaining side plate with two arms and which is pivotally attached to said hand lever for pivoting with respect thereto;

said overridable means including a roller which is rotatably attached to said platen; one arm of said retaining side plate being engageable with said roller as said hand lever is being moved toward said squeezed position thereof;

a torsion spring connected between said hand lever and said side plate for biasing said side plate to turn said one arm thereof toward said roller for engagement therewith.

13. The constant pressure printing mechanism of claim 12, further comprising a control recess formed in said hand lever and positioned for being engaged by the other said arm of said side plate, thereby defining, between the other said arm of said side plate and said recess in said hand lever, the respective said engageable abutments, and said hand lever recess being shaped and positioned and open to receive and abut said other arm of said side plate.

14. The constant pressure printing mechanism of claim 1, wherein said overridable means further comprises a second taper surface following said first taper surface in the direction of motion of said hand lever to said squeezed position and said second taper surface being shaped to permit release of the biasing force exerted by said spring biasing means;

a hole through said platen located beyond said second taper surface, whereby after said element has moved over said first and said second taper surfaces, it slides into said hole;

said second taper surface being provided for permitting said element to return, under spring bias, from said hole through said platen past said second taper surface and then past said first taper surface to the original position thereof when said hand lever is returned to said release position thereof.

15. The constant pressure printing mechanism of either of claims 1 or 5, further comprising stopper means positioned on said frame for being abutted by said platen when said platen has moved to said awaiting position thereof, thereby precluding further motion of said platen in the same said direction and thereby initiating said ride over operation as said platen is held stationary thereafter.

* * * * *